US005568659A

United States Patent [19]

Fogel

[11] Patent Number: 5,568,659

[45] Date of Patent: Oct. 29, 1996

[54] MATTRESS HAVING INTEGRATED THERMAL LAYER FOR REFLECTING BODY HEAT

[76] Inventor: Isaac Fogel, 8214 Wellmoor Ct., Jessup, Md. 20794

[21] Appl. No.: 282,283

[22] Filed: Jul. 29, 1994

[51] Int. Cl.[6] ..... A47C 31/02

[52] U.S. Cl. ..... 5/737; 5/500

[58] Field of Search ..... 5/470, 471, 499, 5/500, 501, 472

[56] References Cited

U.S. PATENT DOCUMENTS

| | | | |
|---|---|---|---|
| 1,892,913 | 1/1933 | Timm | 5/470 |
| 2,222,782 | 11/1940 | Moses | 5/500 |
| 3,262,135 | 7/1966 | Fasanella . | |
| 3,504,387 | 4/1970 | Hummel | 5/499 |
| 3,774,250 | 11/1973 | Miller | 5/471 |
| 4,015,299 | 4/1977 | Tinnel . | |
| 4,147,829 | 4/1979 | Holland . | |
| 4,326,310 | 4/1982 | Frankenberg . | |
| 4,476,593 | 10/1984 | Fanselow et al. . | |
| 4,549,323 | 10/1985 | Brockhaus . | |
| 4,637,947 | 1/1987 | Maeka· a et al. . | |
| 4,658,452 | 4/1987 | Brockhaus . | |
| 4,706,313 | 11/1987 | Murphy . | |
| 4,754,514 | 7/1988 | Limb et al. . | |
| 5,092,006 | 3/1992 | Fogel . | |
| 5,285,542 | 2/1994 | West et al. | 5/500 |

FOREIGN PATENT DOCUMENTS

| | | |
|---|---|---|
| 2431271 | 2/1980 | France . |
| 2916110 | 10/1980 | Germany . |
| 3333707 | 8/1984 | Germany . |

*Primary Examiner*—Michael J. Milanao

*Attorney, Agent, or Firm*—Finnegan, Henderson, Farabow, Garrett & Dunner, L.L.P.

[57] ABSTRACT

A thermal layer is integrated into one of the sleep surface build-ups of a mattress, either between resilient layers of a quilted ticking panel or between a pair of resilient layers underlying the ticking panel. By selectively orienting the mattress, a metallic film incorporated in the thermal layer becomes effective to reflect body heat, thereby warming the upper surface of the mattress in contact with a reclining person.

18 Claims, 2 Drawing Sheets

MATTRESS HAVING INTEGRATED THERMAL LAYER FOR REFLECTING BODY HEAT

BACKGROUND OF THE INVENTION

1. Field of the Invention

The present invention relates to the cushion and sleep system art, and particularly to a sleep system having a thermal layer selectively positioned to reflect body heat.

2. Related Art

In applicant's U.S. Pat. No. 5,092,006, a reversible thermal cushion is disclosed and claimed for use in conjunction with water, innerspring, foam, fibrous, and air mattresses. The thermal cushion is comprised of a thermal layer, including a metallic film, coated on one surface of a thin polyethylene sheet with the other surface of the sheet laminated to a thin layer of polyurethane foam. The thermal layer is held by rivets against the convoluted surface of a thicker polyurethane foam insulating layer or between smooth surfaces of insulating layers of polyurethane foam having convoluted outer surfaces. The riveted layers are encased between polyvinyl chloride sheets, whose edges are lapped and heat-sealed together.

The thermal cushion is placed on top of an innerspring, water or foam mattress, either with the metallic film faced upwardly to reflect body heat back to a reclining person or faced downwardly, such that body heat is absorbed by the thermal cushion.

While this thermal cushion is effective in its function of improving user comfort level, it does involve manufacturing steps apart from the production of the mattress itself. Thus, the thermal cushion is an accessory item which must be separately manufactured and inventoried. Moreover, mattresses must be uniquely structured to accept such thermal cushions in a manner that is both effective and aesthetically pleasing. Due to the additional manufacturing and material costs involved, full enjoyment of the benefits of the thermal cushion involves a commensurate additional expense to the consumer.

SUMMARY OF THE INVENTION

It is accordingly an objective of the present invention to overcome these drawbacks of the accessory thermal cushion by integrating structural features of the thermal cushion into a mattress, cushions and the like, in the factory at the time of manufacture.

To this end, the present invention, according to one embodiment, is directed to an article for selectively providing reflected body heat to a reclining person, which comprises a cover for enveloping a body support section. The cover includes opposed ticking panels joined by a fabric side panel. One of the ticking panels includes an outer fabric sheet, an inner fabric backing sheet, and a thermal layer consisting of a plastic sheet having one surface coated with a heat reflective film and laminated to a sheet of resilient material. The thermal layer is situated between the inner and outer fabric sheets, and quilting stitches maintain the thermal layer and fabric sheets in sandwiched relation. When the body heat reflective properties of the thermal layer are desired, the mattress is turned so that a person reclines on the ticking panel containing the thermal layer. If not, the mattress is flipped, so that the thermal layer is remotely positioned relative to a reclining person.

In accordance with another embodiment of the invention, a mattress, structured in accordance with the article as generally described above, is manufactured as a mattress module for receipt with another mattress module in side-by-side relation in a cavity defined by perimeter walls. The mattress modules and perimeter walls are covered by a cover having an upper fabric ticking panel and a depending side panel. A separable seam in the cover affords access to individually orient the mattress modules depending upon whether or not the body heat reflective property of the thermal layer, incorporated into one ticking panel of each mattress module, is desired.

In accordance with yet another embodiment of the invention, rather than incorporation into one ticking panel of a mattress, the thermal layer is incorporated into the underlying sleep surface build-up of one side of the mattress. Again, mattress orientation determines whether or not the thermal layer is positioned to provide body warming.

Additional objectives and advantages of the invention will, in part, be set forth in the following detailed description and will, in part, be obvious from the description, or may be learned by practice of the invention. It will be understood that both the foregoing general description and the following detailed description are exemplary and explanatory only, and are intended to provide further explanation of the invention as claimed.

The accompanying drawings are intended to provide a further understanding of the invention and are incorporated in and constitute a part of this specification, illustrate embodiments of the invention and together with the description serve to explain the principles of the invention.

BRIEF DESCRIPTION OF THE DRAWINGS

Like reference numerals refer to corresponding parts throughout the several views of the drawings.

DETAILED DESCRIPTION OF THE PREFERRED EMBODIMENTS

Reference will now be made in detail to the present preferred embodiments of the invention, examples of which are illustrated in the accompany drawings.

Figure 1:
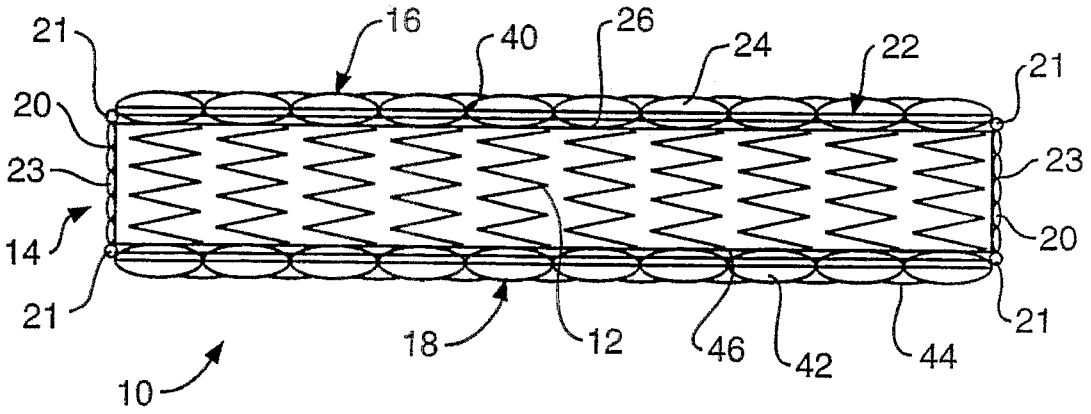
FIG. 1 is a sectional view of a mattress structured in accordance with one embodiment of the invention.

The exemplary embodiment of the present invention illustrated in FIG. 1 is that of a sleep mattress, which is designated generally by reference numeral 10.

As embodied herein and with reference to FIG. 1, mattress 10 includes a resilient body support section 12 which is illustrated as a coiled spring support section of conventional innerspring mattress construction. However, it will be appreciated that the support section may comprise foam, air, water or fibrous material as the resilient medium. The support section 12 is enveloped by a cover, generally indicated by reference numeral 14, which includes opposed, quilted ticking panels 16 and 18 joined on all sides to a fabric side panel 20 by a continuous welt 21. As illustrated, the fabric side panel 20 may be lightly quilted for aesthetic purposes. A separable seam, such as a zipper 23 may be sewn into three or four sides of the side panel, such that cover 14 may be opened and removed for cleaning or replacement.

Figure 2:
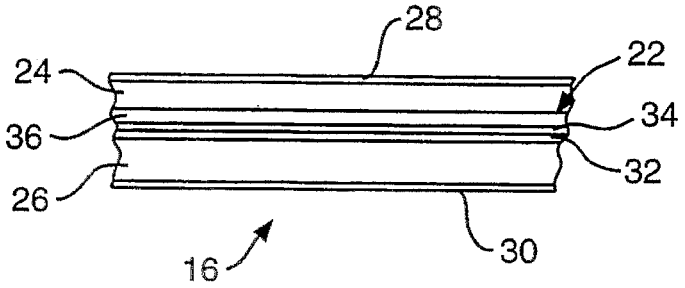
FIG. 2 is a fragmentary, enlarged sectional view of a ticking panel incorporated in the mattress of FIG. 1.

As best seen in FIG. 2, ticking panel 16 includes a thermal layer, generally indicated by reference numeral 22, situated between resilient layers 24 and 26, with a decorative fabric sheet 28 disposed against the outer surface of resilient layer 24 and a fabric backing sheet 30 disposed against the outer surface of resilient layer 26. The resilient layers are preferably of a polyurethane foam material ranging in thicknesses of from one-eighth to three inches. However, the resilient layers may be of other ticking panel resilient materials known in the art, such as fibrous materials, e.g., cotton, wool, or polyester batts.

Thermal layer 22 is preferably formed of a plastic sheet 32 having one surface coated with a thin film 34 of a suitable material having a high thermal reflective property, such as a metallic film, e.g., aluminum. The coating process is preferably vacuum deposition when aluminum is used as the heat reflective material . A suitable plastic sheet material is polyethylene film having a typical thickness of 2.5 mils. The coated surface of the plastic sheet 32 is laminated to a sheet 36 of resilient material, such as polyurethane foam. Sheet 36 may be relatively thin, e.g., one-eighth to one-sixteenth inches thick. An adhesive is a suitable laminating agent.

Ticking panel 16 is then quilted using stitches 40 to preserve the sandwiched relation of layers 22, 24 and 26 between fabric sheets 28 and 30, as well as to provide an aesthetically pleasing appearance.

Ticking panel 18 is preferably also quilted to create the same visual affect as ticking panel 16. However, ticking panel 18 does not include a thermal layer 22. Thus, this ticking panel consists of a pair of resilient layers 42, equivalent to layers 24 and 26 of ticking panel 16, which are quilted between a decorative outer fabric sheet 44 and an inner fabric backing sheet 46. Typically the outer fabric sheets of ticking panel 16 and 18 would have an identical decorative pattern. The physical characteristics of resilient layers 42 of ticking panel 18 preferably are selected to afford the same body feel to a reclining person as ticking panel 16.

To obtain the warming benefits of thermal layer 22, the mattress is oriented with ticking panel 16 uppermost so as to be laid directly upon by a reclining person. It has been determined that, by virtue of the body heat reflected by thermal layer 22, the temperature of the mattress surface contacting a reclining person is raised 1°–4° F. This body-warming effect is particularly desirable in wintertime. In summertime, mattress 10 is turned 180° to position ticking panel 18 as the top (reclining) mattress surface. Ticking panel 16 is then located at the underside of the mattress, a position too remote to reflect any discernible body heat. Appropriate labels (not shown) are applied to the mattress to indicate winter and summer mattress orientations.

It will be appreciated that resilient sheet 36 of thermal layer 22 may be provided in a greater thickness, e.g., one-quarter to three-quarter inches or more, and thus one or both of the resilient layers 24 and 26 can be eliminated from ticking panel 16. Resilient layer(s) equivalent to layers 24 and 26 may then be incorporated into the normal sleep surface build-up of the resilient support section 12 beneath ticking panel 16 (not shown in FIG. 1).

Figure 3:
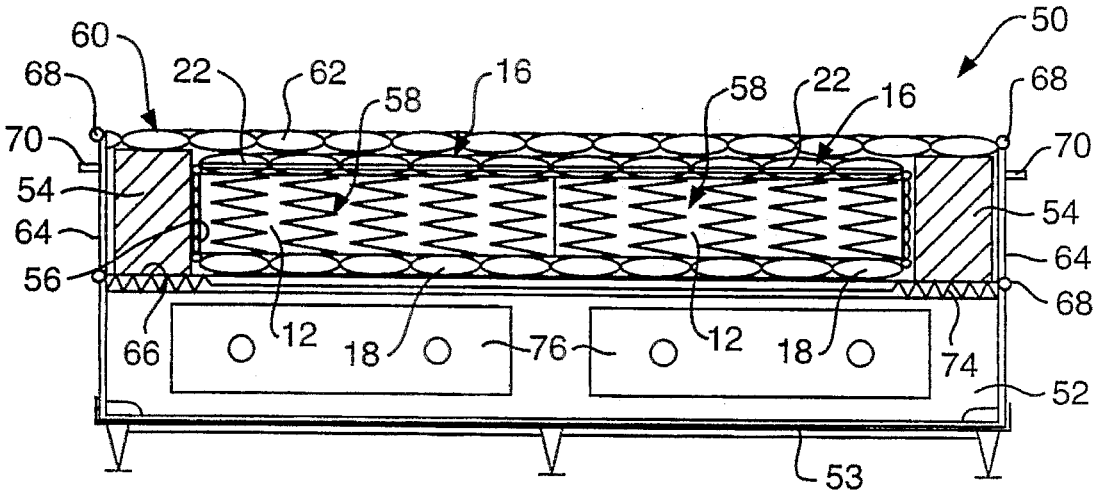
FIG. 3 is an elevational view, partially in section, of an alternative embodiment of the present invention.

In accordance with an alternative embodiment of the invention, mattress 10 is constructed in a modular size appropriate for use as a pair of mattress modules applicable to a two-person bed, such as double, queen and king-sized beds. Thus, as seen in FIG. 3, a mattress, generally indicated by reference number 50 and supported by a foundation 52 mounted by a frame 53, comprises four-sided perimeter walls 54 of a suitable resilient medium, such as polyurethane foam or springs. The perimeter walls define a cavity 56 for accepting mattress modules, generally indicated at 58, in side-by-side relation and extending between head and foot perimeter wall sections 54 of mattress 50.

Each mattress module 58 is constructed in the same fashion as mattress 10 of FIG. 1 and, thus, includes a resilient body support section 12 encased in a cover 14.having a ticking panel 18 and a ticking panel 16 with its integrated thermal layer 22. The mattress modules 58 and perimeter walls 54 are covered by a mattress cover, generally indicated by reference numeral 60 and including a decorative, overlying fabric ticking panel 62, a decorative fabric side panel 64 and a fabric backing panel 66 joined by welts 68 and a continuous zipper 70 sewn into the cover side panel on at least three sides. The zipper 70 permits mattress cover 60 to be opened and ticking panel 62, of conventional construction, to be lifted away to expose mattress modules 58. Rather than a zipper, other access provisions, such as VELCRO seam may be utilized. The mattress modules can then be individually oriented with their thermal layer-integrated ticking panels 16, either up or down according to user preference. In addition, the mattress modules can be of different degrees of firmness, i.e., customized to the individual taste of the persons sharing the bed. Moreover, mattress replacement simply involves replacement of one or both of the mattress modules, not the entire mattress, which represents a significant cost savings. It will also be appreciated that, by virtue of the separate mattress modules, body motions are essentially isolated from one side of the mattress to the other.

Figure 4:
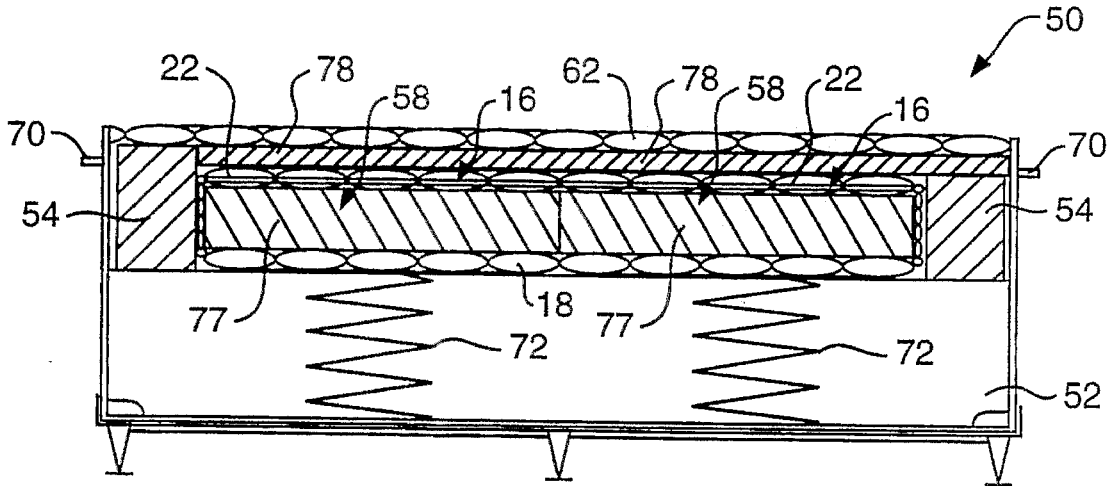
FIG. 4 is an elevational view, partially in section, illustrating modifications of the embodiment of FIG. 3.

As illustrated in FIG. 4, foundation 52 may include conventional boxsprings, indicated at 72, or a flat or planar spring system 74 spanning the upper foundation edges as illustrated in FIG. 3. In the latter case, space is available beneath the spring system 74 to accommodate drawer units 76. FIG. 4 also illustrates mattress modules having foam support sections, as indicated at 77. While not illustrated, the body support sections may be of types using other forms of resilient media, such as air, water and fibrous materials. While two mattress modules 58 have been described and illustrated in FIGS. 3 and 4, many advantages of the invention may be realized using a single mattress module.

FIG. 4 further illustrates that the embodiment of FIG. 3 may include a separate, individually customized body support cushion or pad 78 overlying each half of the bed including one of the mattress modules and contiguous perimeter walls, as depicted for the right half of mattress 50. As illustrated for the left half of FIG. 4, the relative depths of the perimeter walls and the mattress modules may be adjusted to create a shallow recess for accepting side-by-side, cushioned lumbar pads overlying only the mattress modules. Again, a zipper 70 or other equivalent provision affords convenient access to change the lumbar support pads and change or turn mattress modules 58.

Figure 5:
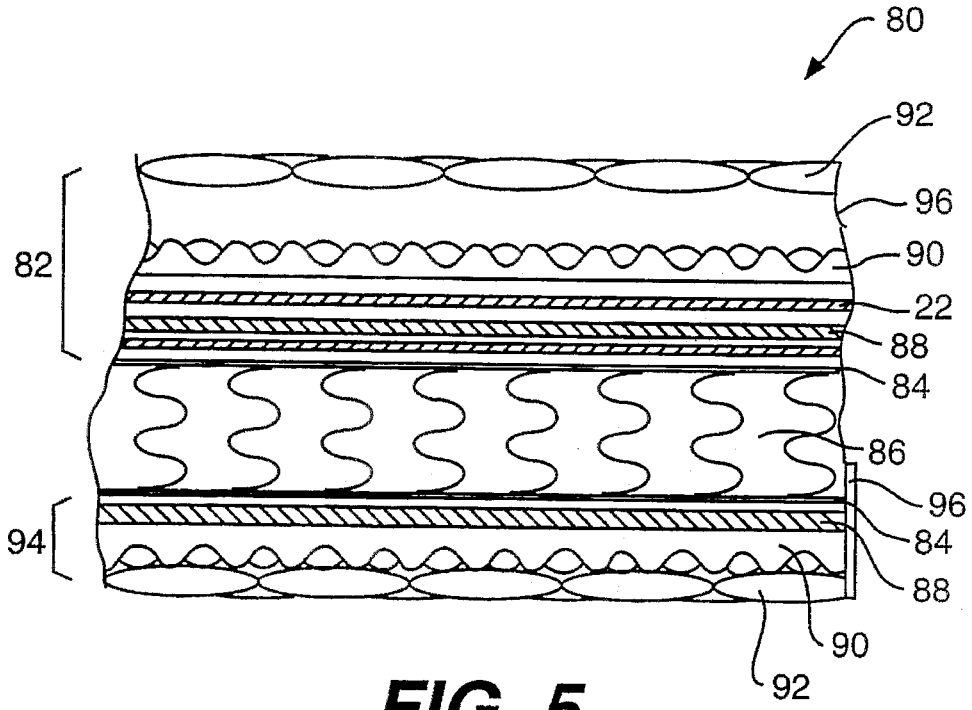
FIG. 5 is fragmentary sectional view of a mattress structured in accordance with yet another embodiment of the invention.

Rather than integrating thermal layer 22 into one ticking panel of a mattress cover, the present invention may be implemented by integrating the thermal layer into the build-up of one sleep surface of a mattress or mattress module. Thus, as seen in FIG. 5, a mattress, generally indicated at 80, includes one sleep surface build-up 82, illustrated in exploded view, that comprises, in succession, an insulator pad 84 lying next to a innerspring body support section 86 as a protective layer, a foam layer 88 (smooth surfaced or convoluted), thermal layer 22, a foam layer 90, illustrated as having a convoluted outer surface, but may be smooth surfaced on inner and outer sides, and a ticking panel 92 of a mattress cover. Build-up of the other sleep surface 94 is the same, except that a thermal layer is omitted. The two quilted ticking panels 92 of the mattress cover are joined by a continuous flange cloth side panel 96. These ticking panels 92 may be of the same construction as ticking panel 18 of the FIG. 1 embodiment. The sleep surface build-ups 82 and 94 are secured to the boxspring support section 86 by conventional means, such as hog rings (not shown). In the case of a foam body support section, the sleep surface build-ups would typically not include insulator pads 84. Adhesives, rivets or tufting would then be used to secure the sleep surface build-ups to the foam or fibrous body support section. As in the other embodiments of the invention, mattress orientation determines whether or not thermal layer 22 is in a position to convey reflected body heat to a reclining person. While FIG. 5 illustrates thermal layer 22 positioned between resilient layers 88 and 90, it will be appreciated that it may be positioned elsewhere, in sleep surface build-up 82, such as between resilient layer 90 and ticking panel 92.

It will be appreciated that, in the case of a double, queen or king size mattress, thermal layer 22 may only be integrated into one-half of one of the mattress sleep surfaces, i.e., one-half of one of the mattress quilted ticking panels or in one-half of one of the mattress sleep surface build-ups beneath the ticking panel, when only one of the two users desires the winter time warming effects of the thermal layer. While the present invention has been described in terms of its application to mattresses, it will be appreciated that the present invention may be implemented in other articles that contact a reclining person, such as mattress covers, seat and back cushions, padded sleeping bags, and the like.

From the foregoing description, it is seen that integration of thermal layer 22 into either one ticking panel of a mattress or mattress module cover or into one sleep surface build-up of a mattress, rather than providing the thermal layer in an accessory cushion, affords significant manufacturing economies. Moreover, quilting the thermal layer 22 into a mattress ticking panel not only preserves the layer positions and integrity, i.e., resists bunching, stretching and tearing, but also effectively suppresses any crinkling noise emitted by the heat-reflecting metallic film due to body motion.

It will be apparent to those skilled in the art that various modifications and variations can be made in the mattress of the present invention without departing from the scope or spirit of the invention. Thus, it is intended that the present invention cover modifications and variations thereof, provided they come within the scope of the appended claims and their equivalents.

We claim:

1. A mattress comprising, in combination:

a resilient body support section having opposed sleep surfaces and a side surface; and a cover enveloping the resilient body support section, the cover including a pair of quilted ticking panels joined by a fabric side panel and arranged such that the ticking panels are respectively positioned against the opposed sleep surfaces and the fabric side panel is positioned against the side surface of the resilient body support section, one of the ticking panels including:

a fabric outer sheet, a fabric inner sheet, a thermal layer situated between the inner and outer sheets and including a plastic sheet adhesively laminated to a resilient sheet and a heat reflective film coating one surface of the plastic sheet, and quilting stitches maintaining the inner and outer sheets and the thermal layer in sandwiched relation.

2. The mattress defined in claim 1, which further includes at least one resilient layer quilted with the thermal layer between the inner and outer sheets.

3. The mattress defined in claim 1, which further includes first and second resilient layers positioned on opposite sides of the thermal layer and quilted between the inner and outer sheets.

4. The mattress defined in claim 3, wherein the first and second resilient layers are foam layers ranging in thicknesses from one-half to one and one-half inches.

5. The mattress defined in claim 2, wherein the other of the pair of ticking panels includes at least one resilient layer sandwiched between a fabric outer sheet and a fabric inner sheet by quilting stitches.

6. A bed comprising, in combination:

a foundation; and a mattress supported by the foundation, the mattress including:

perimeter walls defining a cavity, a pair of mattress modules situated in the cavity in side-by-side relation between the perimeter walls, each mattress module including:

a resilient body support section, a module cover enveloping the resilient body support section, the module cover including a pair of ticking panels joined by a fabric side panel, one of the ticking panels including inner and outer fabric sheets, a thermal layer including a plastic sheet laminated to a resilient sheet and a heat reflective film coating one surface of the plastic sheet, and quilting stitches maintaining the thermal layer and the inner and outer fabric sheets in sandwiched relation; and a mattress cover covering the mattress modules and perimeter walls, the mattress cover including a decorative ticking panel joined by a separable seam to a fabric side panel, the seam affording access to the mattress modules.

7. The bed defined in claim 6, wherein the module cover of each mattress module further includes at least one resilient layer quilted with the thermal layer between the inner and outer sheets.

8. The bed defined in claim 6, wherein the module cover of each mattress module further includes first and second resilient layers positioned on opposite sides of the thermal layer and quilted between the inner and outer sheets.

9. The bed defined in claim 6, wherein the mattress module support sections are constructed to have a different firmness.

10. The bed defined in claim 6, wherein the mattress further incudes a separate, customized body support pad disposed between the mattress cover ticking panel and at least one of the mattress modules.

11. The bed defined in claim 10, wherein the perimeter walls and the mattress modules define a recess accommodating a pair of the body support pads in side-by-side relation.

12. The bed defined in claim 10, wherein the body support pad overlies the mattress modules and the perimeter walls.

13. The bed defined in claim 6, wherein the foundation includes a planar spring system supporting the mattress and at least one drawer unit located beneath the spring system.

14. An article for selectively providing reflected body heat to a reclining person, comprising:

a cover for enveloping a body support section, the cover including a pair of opposed quilted ticking panels for respective positionings against opposed surfaces of the body support section and joined by a fabric side panel, one of the ticking panels including:

a fabric outer sheet, a fabric inner sheet, a thermal layer situated between the inner and outer sheets and including a plastic sheet adhesively laminated to a resilient sheet and a heat reflective film coating one surface of the plastic sheet, and quilting stitches maintaining the inner and outer sheets and the thermal layer in sandwiched relation.

15. The article defined in claim 14, wherein the one ticking panel further includes at least one resilient layer quilted with the thermal layer between the inner and outer sheets.

16. The article defined in claim 14, wherein the cover further includes a separable seam included in the fabric side panel.

17. A mattress comprising:

a resilient body support section having opposed surfaces;

a separate sleep surface build-up attached to the body support section in position against each opposed surface, each sleep surface build-up including at least one inner resilient layer and an overlying quilted ticking panel;

a side panel joining the ticking panel of each sleep surface build-up to provide a cover enveloping the body support section; and a thermal layer situated in only one of the sleep surface build-ups in one of first and second positions, the first position being located between inner and outer fabric sheets of the quilted ticking panel, and the second position being located between the quilted ticking panel and the inner resilient layer, the thermal layer including a plastic sheet adhesively laminated to a resilient sheet and a heat reflective film coating one surface of the plastic sheet.

18. The mattress defined in claim 17, wherein the one sleep surface build-up further includes at least one outer resilient layer against which the thermal layer is located in the first thermal layer position and quilted between the inner and outer fabric sheets, and a pair of inner resilient layers between which the thermal layer is located in the second thermal layer position.

* * * * *